US009527206B1

(12) United States Patent
Hsieh

(10) Patent No.: US 9,527,206 B1
(45) Date of Patent: Dec. 27, 2016

(54) TOOL SUSPENSION RACK

(71) Applicant: Chih-Chien Hsieh, Taichung (TW)

(72) Inventor: Chih-Chien Hsieh, Taichung (TW)

( * ) Notice: Subject to any disclaimer, the term of this patent is extended or adjusted under 35 U.S.C. 154(b) by 0 days.

(21) Appl. No.: 15/172,827

(22) Filed: Jun. 3, 2016

(30) Foreign Application Priority Data

Oct. 8, 2015 (TW) ..... 104216185 U

(51) Int. Cl.
*B25H 3/04* (2006.01)
*B25H 3/00* (2006.01)

(52) U.S. Cl.
CPC ..... *B25H 3/04* (2013.01); *B25H 3/003* (2013.01)

(58) Field of Classification Search
CPC ..... B25H 3/04; B25H 3/003; B25H 3/06; B25B 13/56; B25B 13/06
USPC ..... 206/378, 376, 372, 373, 375, 349; 211/70.6, 13.1, 94.01
See application file for complete search history.

(56) References Cited

U.S. PATENT DOCUMENTS 6,431,373 B1 * 8/2002 Blick ..... B25H 3/003 206/378
6,488,151 B2 * 12/2002 Ramsey ..... B25H 3/06 206/378
7,108,132 B2 * 9/2006 Shih ..... B25H 3/003 206/378
7,841,480 B2 * 11/2010 Hsieh ..... B25H 3/06 206/378
9,126,329 B2 * 9/2015 Kao ..... B25H 3/04
9,186,790 B1 * 11/2015 Kao ..... B25H 3/06
2013/0062480 A1 * 3/2013 Kao ..... B25H 3/04 248/201
2015/0122750 A1 * 5/2015 Kao ..... B25H 3/04 211/13.1
2015/0336262 A1 * 11/2015 Kao ..... B25H 3/06 206/378
2016/0221178 A1 * 8/2016 Hsieh ..... F16M 13/022

* cited by examiner

*Primary Examiner* — Joshua Rodden
*Assistant Examiner* — Hiwot Tefera
(74) *Attorney, Agent, or Firm* — Egbert Law Offices, PLLC

(57) ABSTRACT

A tool suspension rack includes at least one first buckle groove longitudinally defined therein. The first buckle groove includes two buckling portion. At least one socket rack is partially and slidably received in the first buckle groove and laterally buckled into the two buckling portion. At least one end-piece is partially inserted into the at least one end of the tool suspension rack. A buckling hole is defined in a bottom of the at least one first buckle groove. The at least one end-piece includes a hook and a knob for operating the hook, wherein the hook is selectively engaged into the buckling hole. The knob for releasing the hook form the buckling hole extends toward the bottom surface of the tool suspension rack such that an operator presses the knob from the bottom surface.

3 Claims, 4 Drawing Sheets

TOOL SUSPENSION RACK

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a tool suspension rack, and more particularly to a tool suspension rack that has at least one end-piece removably mounted onto at least one end thereof.

2. Description of Related Art Including Information Disclosed Under 37 CFR 1.97 and 37 CFR 1.98.

A conventional tool suspension rack is provided for collecting sockets. The conventional tool suspension rack includes an elongated and flat rack shaft and a buckle groove longitudinally defined in the rack shaft. Multiple socket racks are slidably mounted onto the conventional tool suspension rack by using the buckle groove. The rack shaft has two opposite ends each having an end-piece secured thereon for preventing the socket racks from detaching from the conventional tool suspension rack.

In the early period, the end-piece cannot be detached from the tool suspension rack. Consequently, the amount and the models of the socket racks cannot be changed. It is a very inconvenient structural design.

In view of this, another type of the conventional end-piece for tool suspension is developed. The engaging structures, such as hook and an engaging hole, are formed on two opposite sides of the rack shaft and the end-pieced. However, the rack shaft and the end-piece are thin such that the shaft rack is difficult to laterally define the hole and form the corresponding hook, even using a drilling machine or a punch. In addition, the lateral hole may damage the integrity of the rack shank and the complete periphery of the rack shaft. Furthermore, the hook is laterally and outwardly engaged in the hole. The hook may be inadvertently pressed when the operator holds the rack shaft.

The present invention has arisen to mitigate and/or obviate the disadvantages of the conventional buckling structures between the tool suspension rack and the end-piece.

BRIEF SUMMARY OF THE INVENTION

The main objective of the present invention is to provide an improved tool suspension rack that has at least one end-piece removably mounted onto at least one end thereof.

To achieve the objective, the tool suspension rack in accordance with the present invention is an elongated structure and comprises a bottom surface, a top surface and two opposite ends. At least one first buckle groove is longitudinally defined in the top surface. The first buckle groove includes a bottom and two buckling portion. At least one socket rack is partially and slidably received in the first buckle groove and laterally buckled into the two buckling portion. At least one end-piece is partially and removably inserted into at least one end of the tool suspension rack. A buckling hole is defined in the bottom of the at least one first buckle groove. The at least one end-piece includes a main insertion, a hook and a knob for operating the hook, wherein the main insertion is removably inserted into the at least one first buckle groove in one end of the tool suspension rack and the hook is selectively engaged into the buckling hole. The at least one end-piece includes a resilient arm extending from the main insertion. The resilient arm includes a fixed end and a free end, wherein the hook is formed on a bottom surface of the resilient arm and the knob extends from the free end toward the bottom surface of the tool suspension rack. The knob for releasing the hook form the buckling hole extends toward the bottom surface of the tool suspension rack such that an operator presses the knob from the bottom surface.

Further benefits and advantages of the present invention will become apparent after a careful reading of the detailed description with appropriate reference to the accompanying drawings.

DETAILED DESCRIPTION OF THE INVENTION

Figure 1:
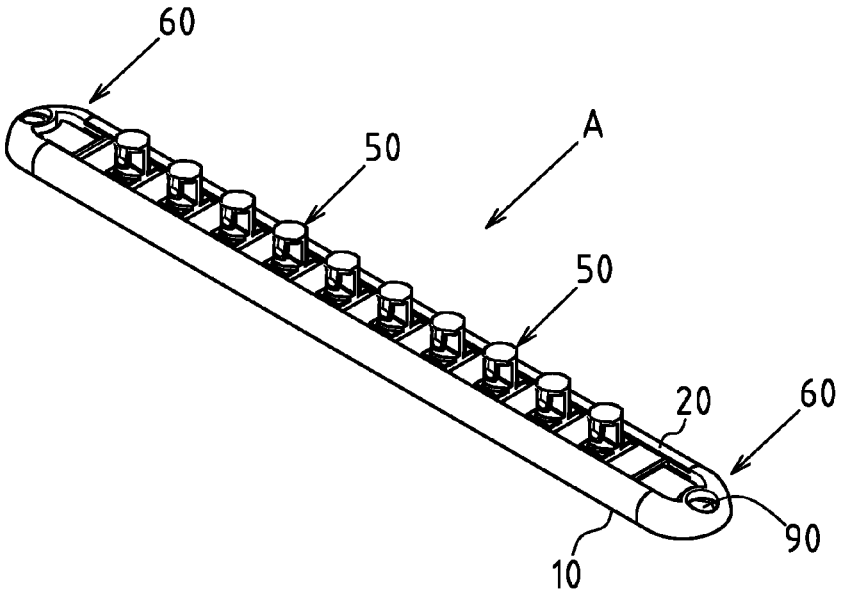
FIG. 1 is a perspective view of a tool suspension rack in accordance with the present invention.

Referring to the drawings and initially to FIGS. 1-5, a tool suspension rack in accordance with the present invention is an elongated structure and comprises a bottom surface 10, a top surface 20 and two opposite ends 30. At least one first buckle groove 40 is longitudinally defined in the top surface 20. The first buckle groove 40 includes a bottom 41 and two buckling portion 42. At least one socket rack 50 is partially and slidably received in the first buckle groove 40 and laterally buckled into the two buckling portion 42. At least one end-piece 60 is partially and removably inserted into at least one end 30 of the tool suspension rack A. A buckling hole 70 is defined in the bottom of the at least one first buckle groove 40. The at least one end-piece 60 includes a main insertion 61, a hook 62 and a knob 63 for operating the hook 62, wherein the main insertion 61 is removably inserted into the at least one first buckle groove 40 in one end 30 of the tool suspension rack A and the hook 62 is selectively engaged into the buckling hole 70. The knob 63 for releasing the hook 62 form the buckling hole 70 extends toward the bottom surface 10 of the tool suspension rack A such that an operator presses the knob 63 from the bottom surface 10.

Figure 2:
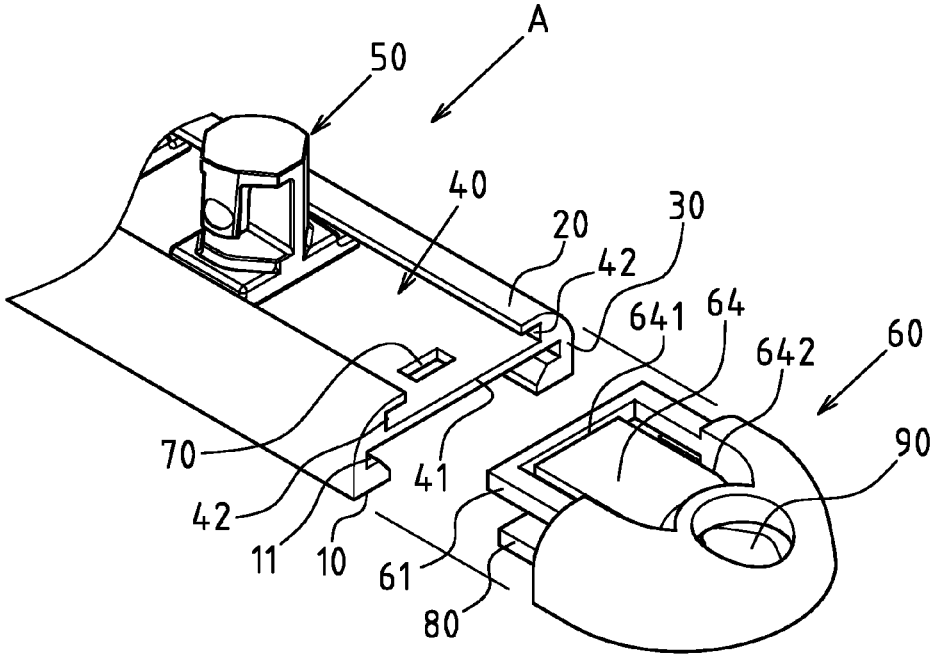
FIG. 2 is a partially exploded perspective view of the tool suspension rack in FIG. 1.
Figure 3:
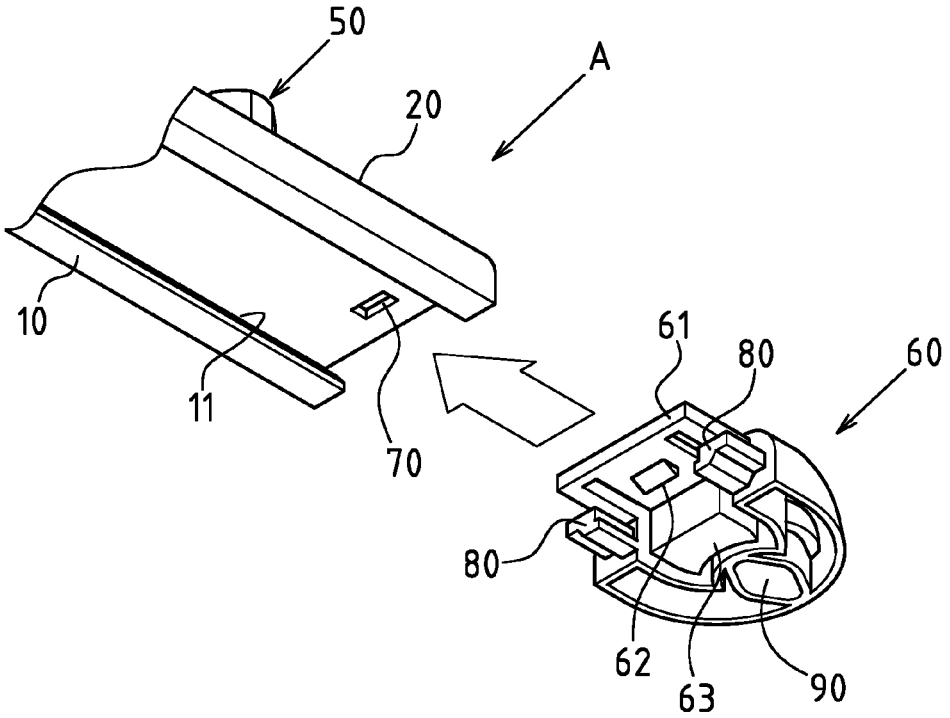
FIG. 3 is an operational view of the tool suspension rack in accordance with the present invention when mounting the end-piece.
Figure 4:
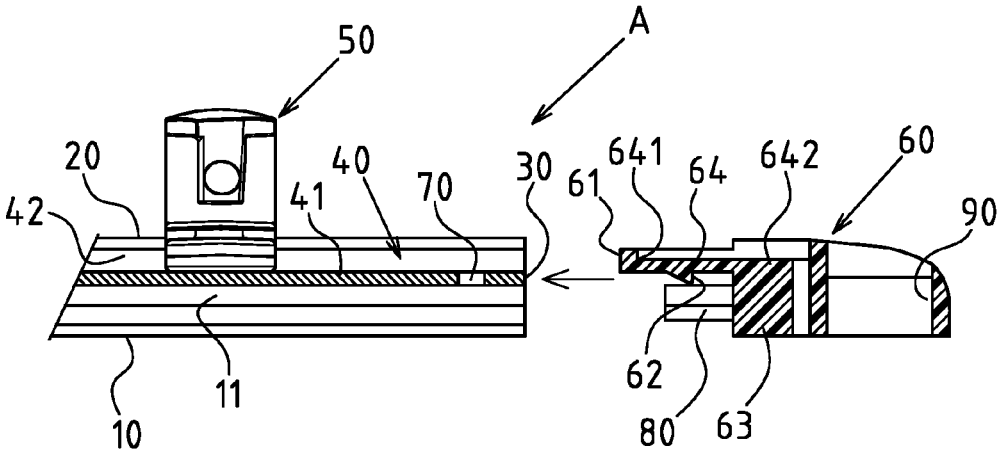
FIG. 4 is a cross-sectional operational view of the tool suspension rack in accordance with the present invention when mounting the end-piece.
Figure 5:
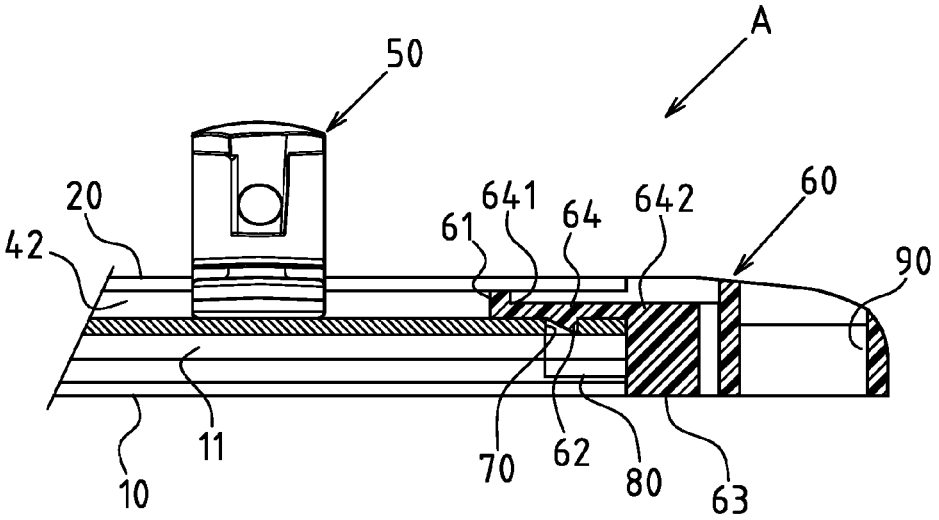
FIG. 5 is a partially cross-sectional view of the tool suspension rack in FIG. 1.

With reference to FIGS. 2, 3 and 4, the at least one end-piece 60 includes a resilient arm 64 extending from the main insertion 61. The resilient arm 64 includes a fixed end 641 and a free end 642, wherein the hook 62 is formed on a bottom surface of the resilient arm 64 and the knob 63 extends from the free end 642 toward the bottom surface 10 of the tool suspension rack A.

With reference to FIGS. 2, 3 and 4, the bottom surface 10 of the tool suspension rack A has two opposite sides each having a second buckle groove 11 defined therein. The at least one end-piece 60 includes two auxiliary insertions 80 extending therefrom under the main insertion 61. Each auxiliary insertion 80 is removably inserted into a corresponding one of the two second buckle grooves 11 for promoting the connection between the tool suspension rack A and the at least one end-piece 60.

Figure 6:
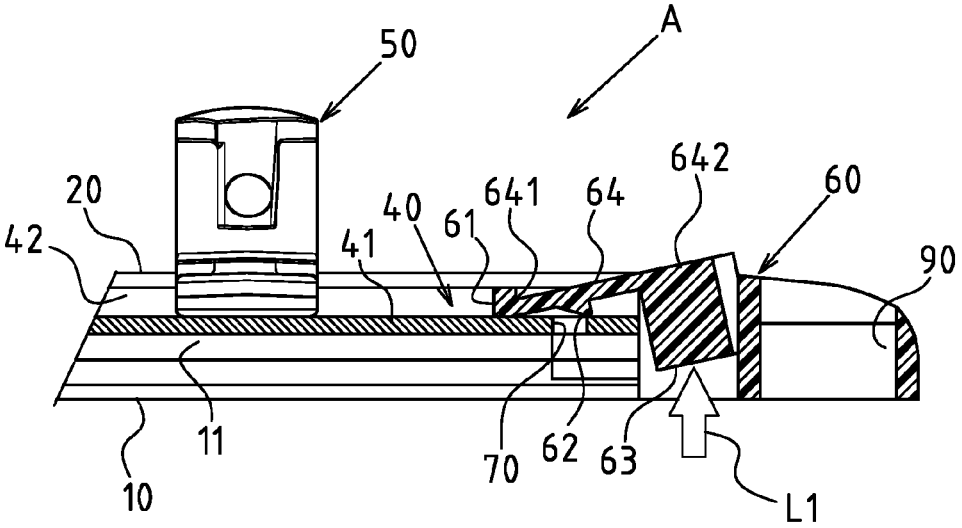
FIG. 6 is a partially cross-sectional view of the tool suspension rack in FIG. 1 when detaching the end-piece from the rack.

With reference to FIGS. 1 and 2, the at least one end-piece 60 includes a hanging hole 90 defined therein for hanging the tool suspending rack A with sockets on the socket racks 50. In the tool suspension rack in accordance with the present invention, the buckling hole 70 is defined in the bottom 41 of the at least one first buckle groove 40 and the knob 63 for releasing the hook 62 form the buckling hole 70 extends toward the bottom surface 10 of the tool suspension rack A. With reference to FIG. 6, the operator presses the knob 63 from the bottom surface 10 of the tool suspension rack A, along the arrow L1, when detaching the at least one end-piece 30 from the tool suspension rack A. The knob 63 for releasing the hook 62 form the buckling hole 70 is hidden in the end-piece 60 for preventing the end-piece 60 from an inadvertently operation and detaching from the tool suspension rack 60. In addition, the buckling hole 70 is defined in the bottom 41 of the at least one first buckle groove 40 such that the tool suspension rack A does needs to process any hole therein and maintains a complete periphery for promoting visual effect and value. Furthermore, the bottom 41 of the at least one first buckle groove 40 is plane such that the manufacturer can easily process the buckling hole 70 for mass-producing the tool suspension rack A.

Figure 7:
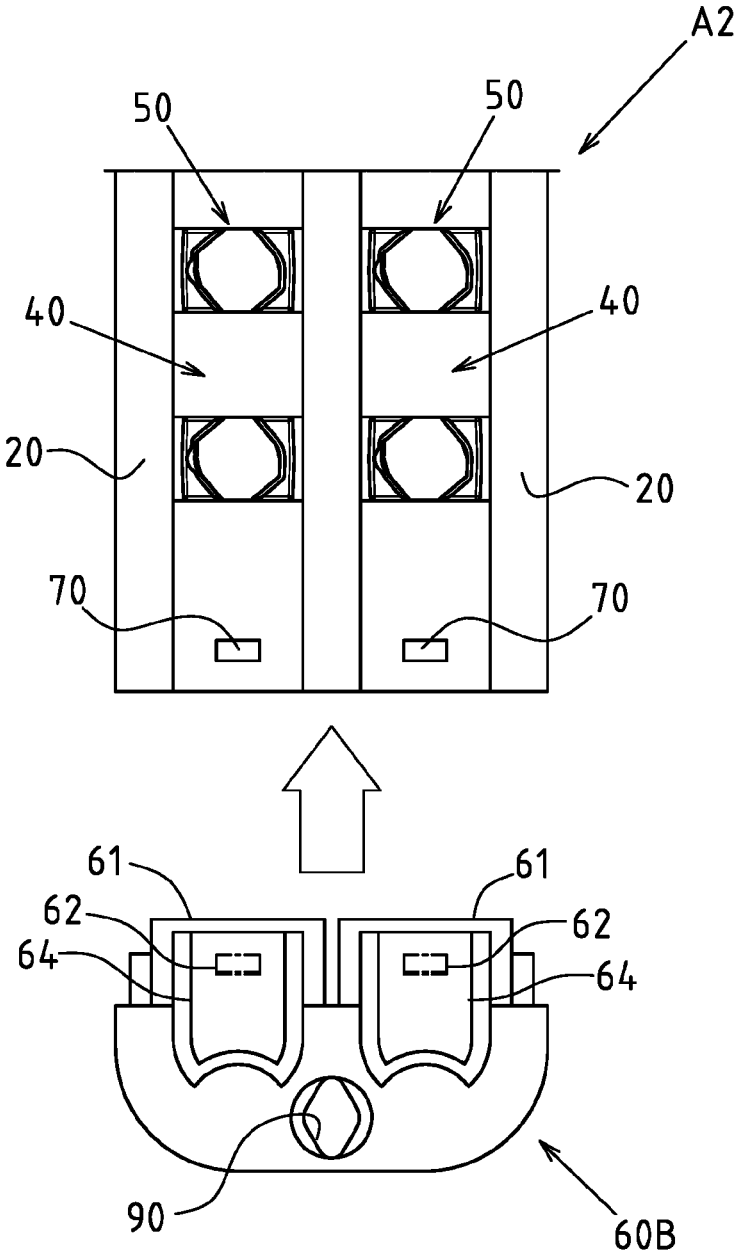
FIG. 7 is a top plan view of a second embodiment of the tool suspension rack in accordance with the present invention.

With reference to FIG. 7 that shows a second embodiment of the tool suspension rack A2 in accordance with the present invention, in this embodiment, the tool suspension rack A2 includes multiple first buckle grooves 40 defined in the top surface 20 thereof and the bottom of each of the multiple first buckle grooves 40 has a buckling hole 70 defined therein. The at least one end-piece 60B has multiple main insertions 61 extending therefrom and each main insertion 61 formed with a hook 62. Each main insertion 61 is removably inserted into a corresponding one of the multiple first buckle grooves 40 and each hook 62 selectively engaged into a corresponding one of the multiple buckling holes 70.

Although the invention has been explained in relation to its preferred embodiment, it is to be understood that many other possible modifications and variations can be made without departing from the spirit and scope of the invention as hereinafter claimed.

I claim:

1. A tool suspension rack being an elongated structure and comprising a bottom surface, a top surface and two opposite ends; at least one first buckle groove longitudinally defined in the top surface, the first buckle groove including a bottom and two buckling portions; at least one socket rack partially and slidably received in the first buckle groove and laterally buckled into the two buckling portions; at least one end-piece partially and removably inserted into at least one end of the tool suspension rack, a buckling hole defined in the bottom of the at least one first buckle groove, the at least one end-piece including a main insertion, a hook and a knob for operating the hook, wherein the main insertion is removably inserted into the at least one first buckle groove in one end of the tool suspension rack and the hook is selectively engaged into the buckling hole; the at least one end-piece including a resilient arm extending from the main insertion, the resilient arm including a fixed end and a free end, wherein the hook is formed on a bottom surface of the resilient arm and the knob extends from the free end toward the bottom surface of the tool suspension rack; the knob for releasing the hook from the buckling hole extending toward the bottom surface of the tool suspension rack such that an operator presses the knob from the bottom surface.

2. The tool suspension rack as claimed in claim 1, wherein the bottom surface of the tool suspension rack includes two opposite sides each having a second buckle groove defined therein and the at least one end-piece includes two auxiliary insertions extending therefrom under the main insertion, each auxiliary insertion is removably inserted into a corresponding one of the two second buckle grooves for promoting the connection between the tool suspension rack and the at least one end-piece.

3. The suspension rack as claimed in claim 2, wherein the at least one end-piece includes a hanging hole defined therein for hanging the tool suspending rack with sockets on the socket racks.

* * * * *